US005940469A

United States Patent [19]

Hell et al.

[11] Patent Number: 5,940,469

[45] Date of Patent: Aug. 17, 1999

[54] MULTI-CHROMATIC X-RAY SOURCE

[75] Inventors: Erich Hell; Wolfgang Knuepfer, both of Erlangen; Peter Schardt, Roettenbach, all of Germany

[73] Assignee: Siemens Aktiengesellschaft, Munich, Germany

[21] Appl. No.: 08/937,074

[22] Filed: Sep. 24, 1997

[30] Foreign Application Priority Data

Sep. 24, 1996 [DE] Germany ..... 196 39 243

[51] Int. Cl.[6] ..... G21K 1/10

[52] U.S. Cl. ..... 378/143; 378/136

[58] Field of Search ..... 378/143, 119, 378/121, 136

[56] References Cited

U.S. PATENT DOCUMENTS 3,919,548 11/1975 Porter ..... 378/143 X 4,048,496 9/1977 Albert ..... 378/143 X

FOREIGN PATENT DOCUMENTS

OS 42 09 226 9/1993 Germany .

OTHER PUBLICATIONS

"Physics of Diagnostic Radiology," Christensen et al. (1972), pp. 13–14.

*Primary Examiner*—David P. Porta
*Attorney, Agent, or Firm*—Hill & Simpson

[57] ABSTRACT

A radiation source for generating multi-chromatic, particularly di-chromatic, x-radiation has at least one cathode and an anode for generating x-ray bremsstrahlung and a target surrounded by the cathode for converting the x-ray bremsstrahlung incident on the target into fluorescence radiation. The target is composed of different materials in sections and the sections can be selectively irradiated with the x-ray bremsstrahlung.

9 Claims, 1 Drawing Sheet

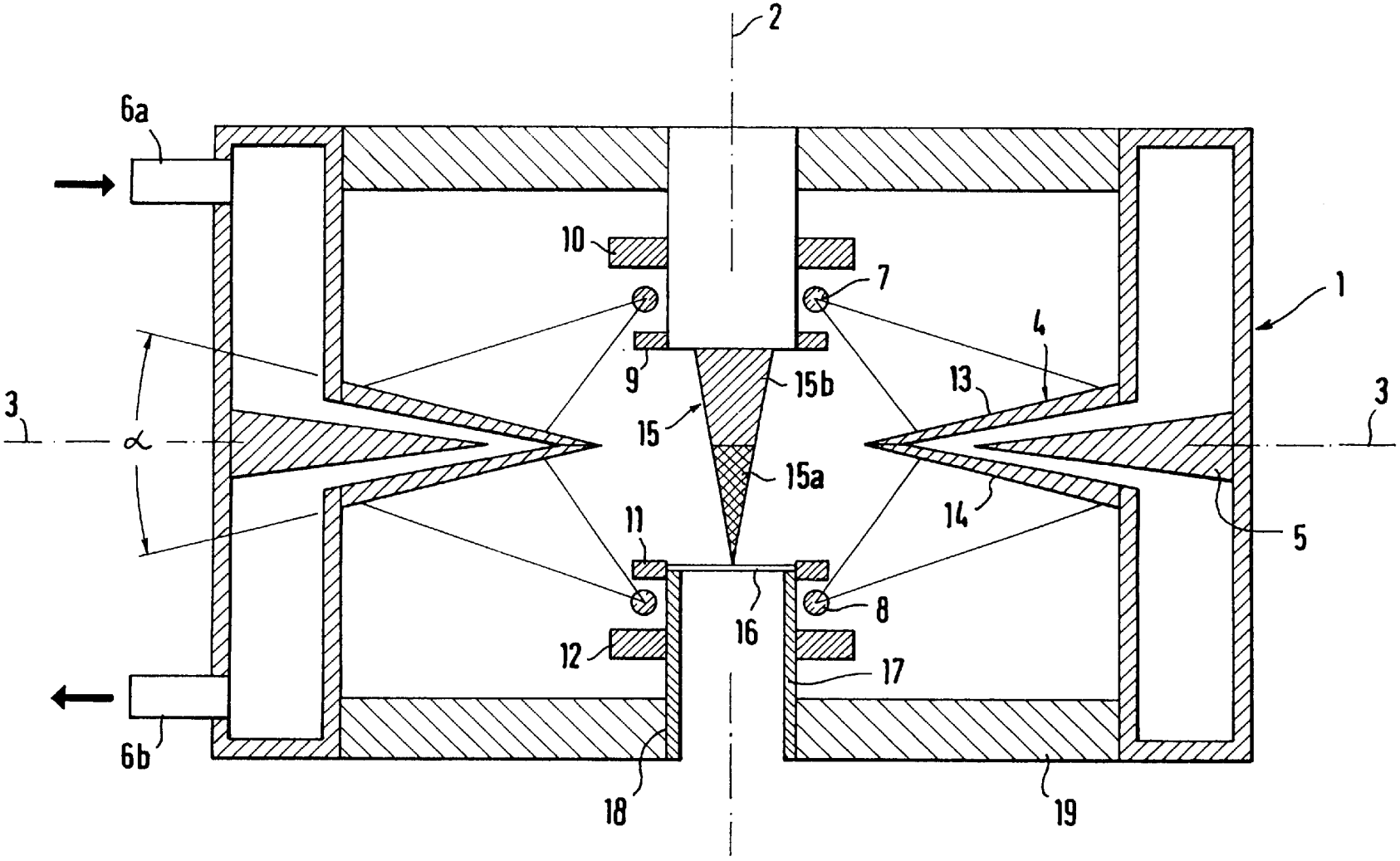
1
2
3
3
4
5
6a
6b
7
8
9
10
11
12
13
14
15
15a
15b
16
17
18
19
α

MULTI-CHROMATIC X-RAY SOURCE

BACKGROUND OF THE INVENTION

1. Field of the Invention

The present invention is directed to a radiation source for generating multi-chromatic, particularly di-chromatic x-radiation, having at least one cathode and an anode for generating x-ray bremsstrahlung and a target surrounded by the anode for converting the x-ray bremsstrahlung incident onto the target into fluorescence radiation.

2. Description of the Prior Art

X-ray sources that generate a continuous x-ray spectrum are almost exclusively employed in medical diagnostics. For a number of applications, however, a monochromatic x-ray spectrum would be advantageous since additional material properties such as, for example, the discontinuous rise in the intensity attenuation at the absorption edges, could thereby be exploited.

Although German OS 42 09 226 discloses a monochromatic x-ray source of the type initially described, this known x-ray source only generates x-radiation at a wavelength defined by the selection of the fluorescence target. Different wavelengths are required, however, for producing images using subtraction techniques. This subtraction method was therefore previously utilized in x-ray diagnostics by employing either x-radiators with continuous bremsstrahlung spectrum and two different acceleration voltages, or a di-chromatic synchrotron source. In the first method with two continuous bremsstrahl spectra shifted relative to one another, however, the absorption edge of the contrast agent is inadequately used. The second approach can be utilized only in conjunction with accelerator rings, and thus not at all in normal hospital use, and moreover requires the use of two-line detectors.

SUMMARY OF THE INVENTION

An object of the present invention is to provide a compact x-ray source having a number of rapidly switchable x-ray frequencies, preferably two rapidly switchable x-ray frequencies.

This object is achieved in accordance with the invention in an x-ray source having a target composed in sections of different materials and wherein the sections can be optionally irradiated with the x-ray bremsstrahlung.

In a first embodiment of the inventive radiation source, a needle-shaped target is employed which is divided in a longitudinal middle plane, and the two halves are composed of the aforementioned different materials, and the cathode is likewise divided and its sections are separately driveable so as to selectively irradiate two sections (maximally in the shape of a half-ring) of the anode lying opposite one another with electrons, from which x-rays only reach one target half.

Dependent on which of the sub-sections of the anode is driven at the moment, thus, x-ray bremsstrahlung is generated only on one part of the anode surface, this is in turn irradiating only one target half composed of different materials, so that only the characteristic fluorescence radiation of this target half can be produced. The switching from one cathode section to the other is possible practically without inertia and without delay, so that the change between the two monochromatic x-ray frequencies can ensue very rapidly. Such a di-chromatic x-ray source is thus excellently suited for the subtraction techniques mentioned earlier, wherein one x-ray frequency lies somewhat above and the other x-ray frequency lies somewhat below the absorption edge of the material of interest.

In a second embodiment of the invention, the target is divided in the middle plane of the anode ring perpendicularly to the ring axis; and the anode ring is provided with an inwardly projecting wedge ring symmetrical to the middle plane. Respective ring cathodes, each with a focusing arrangement, are arranged above and under the middle plane. These rings respectively irradiate only the upper or the lower ring surface of the wedge ring with electrons.

By bringing the tip of the wedge ring close to the target and/or by fashioning the wedge angle smaller than or equal to twice the heel angle of the wedge ring, it can be assured that radiation from one of the ring surfaces of the wedge ring can exclusively reach either the upper half or the lower half of the target, so that an exactly monochromatic fluorescence radiation is generated dependent on whether the upper or the lower ring cathode is employed.

In a further embodiment of the invention a fluid guide surface through which coolant flows is disposed in the hollow ring. This surface is preferably likewise wedge-shaped and inwardly projects into the hollow wedge ring and is spaced therefrom. The coolant also flows through the hollow wedge ring in which, of course, the principal heat quantity is generated due to the incidence of the electrons, and must also be removed therefrom.

It also within the scope of the invention to provide a central x-ray exit window in a bottom plate of the anode ring lying opposite the target tip. The x-ray exit window is preferably arranged on a carrying pipe for the lower ring cathode projecting inwardly from a base opening and on the focusing coils thereof.

Of course, the different divisions of the target could also be combined with one another, so that the target could be composed of four different sections in order to create a quadro-chromatic radiation source with four x-ray frequencies selectable optionally and in rapid sequence. Such an x-ray source with four different frequencies can be very advantageously utilized for other diagnostic purposes. For x-ray diagnostics systems making use of the subtraction method, however, a di-chromatic x-ray source is sufficient, i.e. only a single partition of the target into two sections.

DESCRIPTION OF THE DRAWING

The single FIGURE shows a section through a di-chromatic x-ray source schematically illustrated constructed in accordance with the principles of the present invention.

DESCRIPTION OF THE PREFERRED EMBODIMENTS

In the FIGURE, an x-ray source is shown having an inwardly hollow anode ring 1 that is provided with a hollow, inwardly projecting wedge ring 4 in a middle plane 3 perpendicular to the ring axis 2. In the wedge ring 4, a further wedge in turn projects as a liquid guide surface 5 in order to conduct coolant, which enters the anode ring via an inlet 6*a* and leaves it at an outlet 6*b*, past the inside surface of the wedge ring 4 where most of the heat due to the incident decelerated electrons is to be removed.

Respective cathodes 7 and 8, each in the form of an annular helix, are arranged symmetrically relative to the rotational axis 2 above and below the middle plane 3. Focusing coils 9 and 10, and 11 and 12, respectively focus the electrons emanating from the cathodes 7 and 8 onto the ring regions of the ring surfaces 13 and 14 of the wedge ring. Dependent on whether the upper or lower electrode 7 or 8 is activated, only the upper or lower ring surface 13 or 14 is irradiated with electrons, so that x-ray bremsstrahlung proceeds only from that surface. This x-ray bremsstrahlung strikes a needle-shaped target 15 that is secured to the carrier of the upper cathode 7 symmetrically relative to the rotational axis 2. The target is divided in the middle plane 3, and the lower target half 15*a* is composed of a different material from the upper target half 15*b*. With the change of the cathodes 7 and 8, thus, either the target half 15*b* or the target half 15*a* is irradiated in alternation, so that the material-specific fluorescence radiation is respectively emitted and proceeds toward the exterior via the x-ray exit window 16. This x-ray exit window 16 is seated on a carrying tube 17 for the lower cathode 8 and the focusing coils 1 1 and 12 thereof, and projects into base opening 18 in a bottom plate 19 of the anode ring 1. In the illustrated exemplary embodiment, the wedge angle $\alpha$ of the wedge ring 4 is selected such that it is less than, or at most equal to, twice the heel angle of the wedge ring (see E. E. Christensen et al., "An Introduction to the Physics of Diagnostic Radiology", Lea & Febiger, Philadelphia, 1972, pages 13 and 14). By so doing, radiation is reliably prevented from proceeding from the upper ring surface onto the lower target part 15*a* or from the lower ring surface 14 onto the upper target part 15*b*. Alternatively, or in addition thereto, this risk could be precluded by bringing the tip 20 of the wedge ring extremely close to the target 15. In practice, however, this is generally prevented because the target is at cathode potential in order to prevent a thermal load due to back-scatter electrons, so that the wedge ring 4 and anode potential, of course, cannot be brought too close.

The invention is not limited to the illustrated exemplary embodiment.

As was already described in detail above, thus, the target, instead of being transversely divided in the plane 3, can be longitudinally divided in a plane proceeding through the symmetry axis 2. A division of the cathode into two parts lying at both sides of this separating plane must likewise then ensue in order to optionally irradiate the left or right half of the anode ring with electrons, and thus to trigger x-ray bremsstrahlung only at the irradiated half. The electrodes irradiate only one of the target halves at a time for generating a fluorescence radiation. It would also be possible to combine the two divisions with one another and to thus produce an x-radiator with four frequencies.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray source for generating multi-chromatic x-rays comprising:

a cathode which emits an electron beam;

an anode disposed in a path of said electron beam and emitting x-ray bremsstrahlung upon being struck by said electron beam;

a target on which said x-ray bremsstrahlung is incident which converts the x-ray bremsstrahlung incident thereon into fluorescence radiation, said target being composed of a plurality of sections with each section being comprised of a different material, and said cathode surrounding said target; and means for selectively irradiating one of said sections of said target at a time with said x-ray bremsstrahlung.

2. An x-ray source as claimed in claim 1 further comprising a base plate having a radiation exit window therein disposed opposite said target through which said fluorescence radiation passes.

3. An x-ray source for generating multi-chromatic x-rays comprising:

a cathode comprised of two cathode sections, each capable of emitting, when driven, an electron beam, the respective electron beams emitting by said cathode sections proceeding along respective beam paths;

means for separately driving said two cathode sections for causing only one of said cathode sections to emit an electron beam at a time;

an anode composed of two anode sections disposed opposite each other, said anode sections being respectively disposed in said respective beam paths so that each anode section is struck by only one of said electrode beams respectively emitted by said cathode sections, each of said cathode sections, when struck by the respective electron beam, emitting x-ray bremsstrahlung; and a needle-shaped target having a longitudinal middle plane dividing said target into two target sections, the bremsstrahlung emitted by the respective anode sections being respectively incident on said target sections, each of said target sections being comprised of a different material and converting the bremsstrahlung respectively incident thereon into fluorescence radiation.

4. An x-ray source as claimed in claim 3 wherein said anode comprises an anode ring having an anode ring axis and wherein said longitudinal middle plane of said needle-shaped target is disposed perpendicular to said ring axis, said anode ring having a wedge ring projecting toward said anode ring axis and being symmetrical relative to said longitudinal middle plane of said wedge ring having an upper surface forming a first of said two anode sections and a lower surface forming a second of said two anode sections target, and wherein said two sections of said cathode respectively comprise a firs cathode ring, disposed above said middle plane of said target, and first focusing means for focusing an electron beam emitted by said first ring cathode only onto said upper surface of said wedge ring, and a second ring cathode, disposed below said longitudinal middle plane of said target, and second focusing means for focusing an electron beam emitted by said second ring electrode onto said lower surface of said wedge ring.

5. An x-ray source as claimed in claim 4 wherein said wedge ring has a hollow interior, and said x-ray source further comprising a liquid guide surface projecting into said hollow interior of said wedge ring and forming a coolant channel in said wedge ring.

6. An x-ray source as claimed in claim 5 wherein said guide surface has a wedge-shape.

7. An x-ray source as claimed in claim 4 wherein said wedge ring has a heel angle associated therewith, and wherein said upper and lower surfaces of said wedge ring are disposed relative to each other at a wedge angle which is less than or equal to twice said heel angle.

8. An x-ray source as claimed in claim 7 wherein said cathode comprises upper and lower ring cathodes respectively disposed above and below said target, and first and second sets of focusing coils respectively oriented relative to said first and second ring cathodes for focusing respective electron beams emitted thereby, and wherein said x-ray source further comprises a carrying tube for said lower ring cathode, said carrying tube projecting toward said target from said base plate, and said focusing coils for said lower ring cathode being mounted on said carrying tube and said x-ray exit window being disposed in said carrying tube.

9. An x-ray source for generating multi-chromatic x-rays comprising:

a cathode at a cathode potential which emits an electron beam;

an anode disposed in a path of said electron beam and emitting x-ray bremsstrahlung upon being struck by said electron beam;

a target on which said x-ray bremsstrahlung is incident which converts the x-ray bremsstrahlung incident thereon into fluorescence radiation, said target being composed of a plurality of sections with each section being comprised of a different material;

means for placing said target at said cathode potential; and means for selectively irradiating one of said sections at a time with said x-ray bremsstrahlung.

* * * * *